US006306253B2

(12) United States Patent
Henricson

(10) Patent No.: US 6,306,253 B2
(45) **Date of Patent: *Oct. 23, 2001**

(54) ACID TREATMENT OF PULP AT HIGH TEMPERATURE PRIOR TO CHLORINE DIOXIDE BLEACHING

(75) Inventor: Kaj O. Henricson, Helsinki (FI)

(73) Assignee: Andritz-Ahlstrom Oy, Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/051,678

(22) PCT Filed: Oct. 18, 1996

(86) PCT No.: PCT/FI96/00552

§ 371 Date: Apr. 14, 1998

§ 102(e) Date: Apr. 14, 1998

(87) PCT Pub. No.: WO97/15713

PCT Pub. Date: May 1, 1997

(30) Foreign Application Priority Data

| | | |
|---|---|---|
| Oct. 20, 1995 | (FI) | 955007 |
| Nov. 21, 1995 | (SE) | 9504147 |
| Dec. 7, 1995 | (FI) | 955878 |
| Jan. 17, 1996 | (FI) | 960214 |

(51) Int. Cl.[7] ..... D21C 9/10; D21C 9/14

(52) U.S. Cl. ..... 162/65; 162/67; 162/76; 162/88

(58) Field of Search ..... 162/76, 78, 65, 162/88, 89, 67, 66

(56) References Cited

U.S. PATENT DOCUMENTS

| | | | | |
|---|---|---|---|---|
| 3,507,743 | | 4/1970 | Cartsunis et al. | 162/72 |
| 5,438,737 | * | 8/1995 | Diaddario | 162/78 |

FOREIGN PATENT DOCUMENTS

| | | | | |
|---|---|---|---|---|
| 0511695 | | 11/1992 | (EP) . | |
| 0622491 | | 11/1994 | (EP) . | |
| 433 138 | * | 11/1994 | (EP) | 162/76 |
| 622 491 | * | 11/1994 | (EP) | 162/76 |
| 1062734 | | 3/1967 | (GB) . | |
| WO 9412721 | | 6/1994 | (WO) . | |
| 95/12709 | * | 5/1995 | (WO) | 162/76 |
| PCT/SE95/00486 | | 2/1996 | (WO) | D21C/9/10 |
| WO 9612063 | | 4/1996 | (WO) . | |
| WO 9625552 | | 8/1996 | (WO) . | |

OTHER PUBLICATIONS

Lachenal et al, "Oprimization of bleaching sequences using peroxide as first stage", 1982 Int. Pulp Bleaching Conf., Tappi Proceedings, pp. 145–151.*

* cited by examiner

*Primary Examiner*—Steve Alvo
(74) *Attorney, Agent, or Firm*—Nixon & Vanderhye P.C.

(57) ABSTRACT

In the treatment of cellulose pulp in connection with bleaching, the pulp is first cooked and, if necessary, oxygen delignified in order to reduce the Kappa number below 24, preferably below 14, and after that the pulp is treated in an acid stage at a pH of 2–5 and at a temperature range of 75–130° C. in order to reduce the Kappa number by 2–9 units. To prevent essential weakening of the strength properties of the pulp in the acid stage treatment tower, the retention time, t min, is 30 to 300 minutes and the treatment temperature, T° C. is $T_{min}<T<T_{max}$, in which $$T_{\min} = \frac{10517}{24 + \ln(2t)} - 273$$

and $$T_{max}=T_{min+23°\ C.}$$

7 Claims, 6 Drawing Sheets

ACID TREATMENT OF PULP AT HIGH TEMPERATURE PRIOR TO CHLORINE DIOXIDE BLEACHING

The present invention relates to a method and apparatus for treating pulp at a pH of 2–5 and at a temperature of 75–130° C. in connection with bleaching, Chemical pulp has been produced conventionally by first digesting pulp usually with sulphate or sulphite cooking liquor either in a continuous or a batch digestion process, by delignifying and screening the pulp before a bleaching process. The bleaching was still in the 1980's commonly done by using chlorine dioxide.

In the 1990's efforts have been made to replace chlorine dioxide with oxygen, ozone and/or peroxide because environmental factors force pulp mills to employ either totally chlorine-free or at least elemental chlorine-free processes. Sequences using chlorine dioxide are, however, still popular in many countries and possible also in view of the environment. There are many reasons for this. The price of chlorine dioxide is very competitive compared to other chemicals; for example its price is today only half of the price of the competing peroxide. Also the strength properties and brightness of the pulp produced by chlorine dioxide bleaching are good; in fact at least of the same order as when using peroxide at the same consumption of chemical (kg/adt).

When the bleaching of cellulose pulp is based on the use of such bleaching chemicals as oxygen, peroxide, or ozone, the removal of heavy metals forms an essential process stage. Detrimental metals include manganese, copper and iron, which catalyze reactions harmful to the quality of pulp. They degrade bleaching chemicals, which decreases the efficiency of bleaching and increases the consumption of chemicals. It has been suggested that removal of metals be effected by pretreating the pulp prior to the critical bleaching stage with an acid, e.g. sulphuric acid whereby metals are detached from fibers to the liquid phase in the pulp. Before the bleaching stage itself the pulp is still washed by displacing the liquid in the pulp by cleaner wash liquid.

In acid treatments which are used to remove metals the temperature is usually not of significant importance. The most essential feature is that the pH of the pulp is so low (usually 1.5–2) that metals are detached from fibers. In laboratories the treatment is usually carried out at room temperature. In mills the metal removal is typically effected at a temperature range of 60–85° C., which is the temperature naturally prevailing in the acid treatment stage as a consequence of water circulations. If the mill would for some reason want to effect the acid treatment at a higher temperature the acid stage would have to be heated separately by steam or by a corresponding method. Naturally, this has been avoided because of the belief that the strength properties of the pulp would impair. Based on the state of the art knowledge there has been no reason to use hot acid stages.

It has been discovered recently that sulphate pulps contain significant amount of 4-deoxy-β-L-threo-hex-4-enopyranosyl uronic acid groups (hexenuronic acid groups) bound to xylan. Further, it has been found out (patent application WO 96/12063) that by removing hexenuronic acid groups from the pulp its Kappa number may be decreased remarkably. These acids are removed by adjusting the pH of the pulpito the range of 2–5, preferably 2.5–4 and the temperature of the pulp preferably to 90–110° C. and allowing these conditions to act on the pulp for a certain time and subsequently the pulp has been washed according to the publications mentioned above. By this kind of removal of hexenuronic acids, significant saving are obtainable in the consumption of bleaching chemicals which react electrophilically, such as ozone, peracids and chlorine dioxide, because they react with these acid groups.

When the acid treatment mentioned is used in connection with peroxide bleaching the brightness reversion of the pulp has been found to decrease.

As was stated above until now acid treatments at high temperatures have consciously been avoided as they have been believed to have a negative effect on the strength properties of the pulp.

An object of the present invention is to provide a method of carrying out acid treatment at a high temperature so that the strength properties of the pulp do not degrade during the treatment.

The characteristic features of the method and the apparatus of the invention are disclosed in the appended patent claims.

According to the method of the present invention the pH of the pulp, which has been delignified during digestion and possibly oxygen delignified after that and having a Kappa number of less than 24, preferably less than 14, is adjusted to a slightly acid range, e.g. 2–5, preferably 2.5–4. The temperature of the pulp is raised to 75–130° C., preferably 90–110° C. Then the Kappa number of the pulp reduced by 2–9 units, preferably 3–6 units. In order to obtain this, a retention time of 30–300 minutes, preferably 45–150 minutes, is required. The acid treatment may be effected at atmospheric pressure or as a pressurized process depending on the conditions. A preferred pressure is 0.1–1 MPa. At least 30%, preferably 50% of the hexenuronic acids contained in the pulp are degraded in this way.

One of the central ideas of the present invention is that the acid treatment is effected by minimizing the treatment temperature and/or treatment time of the pulp in order to optimize the strength properties of the pulp. It has been discovered that an adequate decrease in Kappa number and removal of hexenuronic acids is obtained when the treatment temperature is at least $T_{min}$° C.

$$T_{\min} = \frac{10517}{24 + \ln(2t)} - 273$$

t=retention time, min

The equation has been presented graphically in FIG. 1. The degradation of hexenuronic acid groups follows the reaction kinetics of the first order. It is known that the dependency between the affinity constant k and the temperature T (K) is $k=A\ e^{-E/RT}$ (equation of Arrhenius) in which A is constant depending on the reaction, E is activation energy and R is gas constant. On the other hand it is known that the reaction time for the reaction of the first order is $t=(1/k)\ln(c_0/c)$ in which c is the hexenuronic acid content and $c_0$ the initial content. By using the Arrhenius equation and the equation $t=(1/k)\ln(c_0/c)$ and test results, the above $T_{min}$ expression ensues. Further, it has now been discovered that in order to prevent the strength properties of the pulp from being deteriorated the highest employable treatment temperature $T_{max}$° C. is $$T_{\max} = \frac{10517}{24 + \ln(2t)} - 250$$

On the other hand, it may be stated that $$T_{max}=T_{min}+23^\circ\ \text{C.}$$

According to a particular aspect of the invention high quality pulp is produced by adjusting the acid treatment temperature to a range of $T_{min}$–$T_{max}$ while the retention time is 30–300 minutes. In FIG. 1, the lower curve illustrates $T_{min}$ and the upper one $T_{max}$. Favourable treatment conditions lie in the area between these. Typical operation conditions are those depicted by points A (90° C., 180 min), B (95° C., 120 min), and C (100° C., 70 min).

In order to preserve the pulp strength properties and to obtain homogenous pulp by acid treatment it is essential that the flow of pulp through the acid tower is smooth and no portions of pulp remain in the tower for example due to channelling for a longer or for a shorter time than the predetermined retention time. This may be prevented by using means controlling the feed and the discharge of pulp in an upward flow tower and means for controlling the level of pulp in a downward flow tower. The feed members must be able to distribute the pulp evenly over the whole cross-sectional area of the pulp tower. The optimization of treatment conditions may be facilitated by using two or more successive acid towers which makes it possible to act on the treatment conditions, for example by regulating the temperature or the pH, or by adding chemicals which are advantageous for the treatment, e.g. chelating agents to remove metals from the pulp, or merely by mixing the pulp.

By means of the invention, it is possible to manufacture easily bleachable cellulose pulp by means of a sulphate method or an equivalent alkalic method bringing hexenuronic acids into the pulp. It is characteristic of the pulp manufactured according to the invention that it contains a small amount of hexenuronic acids at the most and the hexenuronic acids are removed in a controlled way so that the strength properties of the pulp are not impaired. The pulp produced can be easily bleached without chlorine (ECF) or chlorine chemicals (TCF), or even with oxygen gas and/or peroxide, alone. An advantage provided by the decomposition of hexenuronic acids is that the consumption of bleaching chemicals is substantially reduced.

Another central idea of the invention is to combine the treatment described above to another treatment, preferably to a peroxide stage or an acid bleaching stage, for example a chlorine dioxide stage, an ozone stage, a chlorine stage, or an acid peroxide stage (which is usually effected with a peracid). Performed tests have surprisingly shown that the breakdown products of hexenuronic acids need not be washed off from the pulp before the following bleach treatment but the bleach treatment may be carried out in the subsequent treatment tower without an intermediate wash. Thus, compared with the processes described in prior patent applications, the mill can manage with remarkably smaller washer investments because the washer following the acid treatment may by left out altogether.

The method of the present invention may be applied advantageously in connection with the following bleaching sequences or partial bleaching sequences (in other words, the sequence may include also other treatment stages in addition to the ones mentioned in the following examples):

An acid stage combined at first with chlorine dioxide bleaching

Digestion—O—AD—ZD
Digestion—O—$AD_N$—D
Digestion—O—AD—D
Digestion—O—ADQ—$O_p$—D
Digestion—O—ADQ—$O_p$—ZD
Digestion—O—ADQ—P
Digestion—O—AD—$O_p$—D
Digestion—O—AD—$O_p$—ZD
Digestion—O—AD—P, in which the AD may be performed in the order DA and the ADQ stage in the order AQD, DAQ, DQA, QDA or QAD, or an acid stage combined with acid peroxide bleaching Digestion—O—$AP_aQ$—$O_p$—D,
Digestion—O—$AP_aQ$—$O_p$—ZD,
Digestion—O—$AP_aQ$—P
Digestion—O—AQ—$ZP_aQ$—P
Digestion—O—$AP_aQ$—$O_p$—ZD,
Digestion—O—$P_aA$—ZD
Digestion—O—$AP_a$—D
Digestion—O—$P_aA$—D
Digestion—O—$P_aAQ$—P
Digestion—O—$AP_aQ$—P
Digestion—O—A—$P_aQ$—P in which $AP_aQ$ may be performed in the order $AQP_a$, $QAP_a$, $QP_aA$, $P_aAQ$ or $P_aQA$.

If the digestion has brought the Kappa number down sufficiently the O stage may be eliminated which gives a sequence:

Digestion—AD—ZD
Digestion—$AD_N$—D
Digestion—AD—D
Digestion—ADQ—$O_p$—D
Digestion—ADQ—$O_p$—ZD
Digestion—ADQ—P
Digestion—AD—$O_p$—D
Digestion—AD—$O_p$—ZD
Digestion—AD—P
Digestion—$AP_aQ$—$O_p$—D
Digestion—$AP_aQ$—$O_p$—ZD
Digestion—$AP_aQ$—P
Digestion—$AP_aQ$—$O_p$—ZD
Digestion—$P_aA$—ZD
Digestion—$AP_a$—D
Digestion—$P_aA$—D
Digestion—$P_aAQ$—P
Digestion—$AP_aQ$—P
Digestion—AQ—$P_aQ$—P
Digestion—AQ—$ZP_aQ$—P—.

The same alternatives which were presented earlier apply also to the sequences presented here, i.e. both the ADQ stage and the $AP_aQ$ stage may be performed in a different order.

If it is desirable to bleach the pulp before a D stage with a chlorine-free bleaching chemical the following sequences which most often use ozone are advantageous:

Digestion—O—AQ—ZDQ—P
Digestion—AQ—ZDQ—P

If it is desirable to bleach pulp totally without chlorine the following sequences are favourable:

Digestion—O—AQ—ZQ—P
Digestion—O—AQ—P
Digestion—O—AQ—O—ZQ—P
Digestion—AQ—ZQ—P
Digestion—AQ—P
Digestion—AQ—O—ZQ—P
Digestion—Q—O—$AP_aQ$—P.

Further, the ZD, ZQ and ZDQ stages may be performed in a different order.

An acid stage combined with peroxide bleaching:

Digestion —O—Q—AP
Digestion —O—Q—PA or an acid stage combines with acid peroxide bleaching:

Digestion —O—Q—$AP_a$
Digestion —O—Q—$P_aA$

If the digestion has brought the Kappa number of the pulp down sufficiently the O stage may be eliminated which gives sequences:

Digestion —Q—AP
Digestion —Q—PA

Digestion —Q—$AP_a$
Digestion —Q—$P_aA$

The following abbreviations have been used in all the above sequences:

A=an acid treatment at a raised temperature according to the present invention
O=oxygen treatment
$O_p$=an oxygen treatment intensified with peroxide
D=a chlorine dioxide treatment in which DA means two successive towers D and A without an intermediate wash. This may be marked also by D/A. Also abbreviations AD, AP, PA, AZ, ZA, $AP_a$, $P_aA$, ZQ and AQ indicate the corresponding situation.
$D_N$=chlorine dioxide treatment with neutralization
P=peroxide treatment
$P_a$=acid peroxide stage usually performed with peracid
$P_n$=several successive peroxide treatment stages
E=alkaline stage
Z=ozone treatment
Q=chelating agent treatment
"–"=wash between stages All the above sequences may use either pressurized or atmospheric bleaching steps/stages. Further, the bleaching steps/stages may be carried out at a temperature of over or below 100° C. depending on the goal of the step/stage in question. Also the oxygen and peroxide (P) stages may be carried out as a one-step or a multi-step process as has been described in prior patent applications. Concisely expressed, it may be stated that the method and apparatus described in our patent applications FI 892243, FI 924805, FI 925159, FI 925558, FI 930954, FI 934036, FI 934056, FI 935784, FI 941229, FI 942341, FI 943001, FI 944144, FI 944348, FI 945139, FI 950200, SE 9500573, FI 950749, FI 950785, FI 951196, SE 9502078, FI 953343, FI 953064, FI 953074 and FI 953305 and in patents already granted based on these applications may be used to practise the present invention.

It is characteristic of the present invention that the acid treatment described above is preferably carried out after oxygen delignification. However, an oxygen delignification stage is not necessary if the Kappa number of the pulp has been brought down sufficiently in connection with the digestion, i.e. to a number less than 24, preferably less than 14. Instead of or in addition to the oxygen delignification stage, the further treatment of the pulp may also be some other delignification or bleaching stage by means of which the Kappa numbers mentioned above are reached. A stage of this kind may be for example a chlorine stage, an ozone stage, or a second oxygen treatment stage.

The purpose of the chelating agent is to bind harmful metals such as manganese from the pulp. Stages AQ and ZQ are preferably effected in a two-tower system. It should, however, be stated that the acid treatment according to the invention also removes harmful metals efficiently and thus the use of a chelating agent is usually not necessary. Thus, the Q stage may be omitted from the combination AQ, ZQ etc, or the method described in pending U.S. patent application Ser. No. 566,665 "Alkaline treatment for metal ion removal during pulp bleaching" filed on Dec. 4, 1995 may be used to replace the Q stage or it may be used as the Q stage. The use of a chelating agent prior to a bleaching stage combined with an acid stage is, however, often advantageous in order to bring about a suitable metal profile in the pulp before bleaching.

Various acids, inorganic acids, for example mineral acids such as sulphuric acid, hydrogen nitrate and hydrochloric acid, as well as organic acids such as formylic acid and/or ethylic acid may be used to adjust the pH of the pulp suspension.

When an acid treatment has been combined in the same treatment stage with peroxide treatment (AP) the utilization of the residual peroxide may cause a problem. This bleaching stage is preferably effected by providing in the process prior to the acid treatment tower a press, preferably a washing press, in which the pH of the pulp is decreased to the range of 3–5 and the consistency of the pulp is raised to the range of 20–40%. Thus the acid treatment is carried out with high-consistency pulp. For the peroxide step following the acid treatment the pulp is diluted to the consistency range of 10–20% by using the peroxide-containing filtrate from the filter following the peroxide tower. In this way the residual peroxide may be utilized although according to the invention there is no intermediate wash between the acid tower and the peroxide tower.

BRIEF DESCRIPTION OF THE DRAWINGS

The method and the apparatus of the invention are described more in detail by way of example below with reference to the accompanying drawing figures of which

FIG. 2 illustrates a way of effecting a preferred embodiment of the acid treatment. Pulp is transferred by a high-consistency pump 12 from a previous treatment stage 10 to an acid tower 18. The consistency of the pulp is 6–25%, preferably 8–18%. The previous treatment stage may be a wash following the digestior or, which is more common, an oxygen delignification stage or a wash stage following it.

Figure 1:
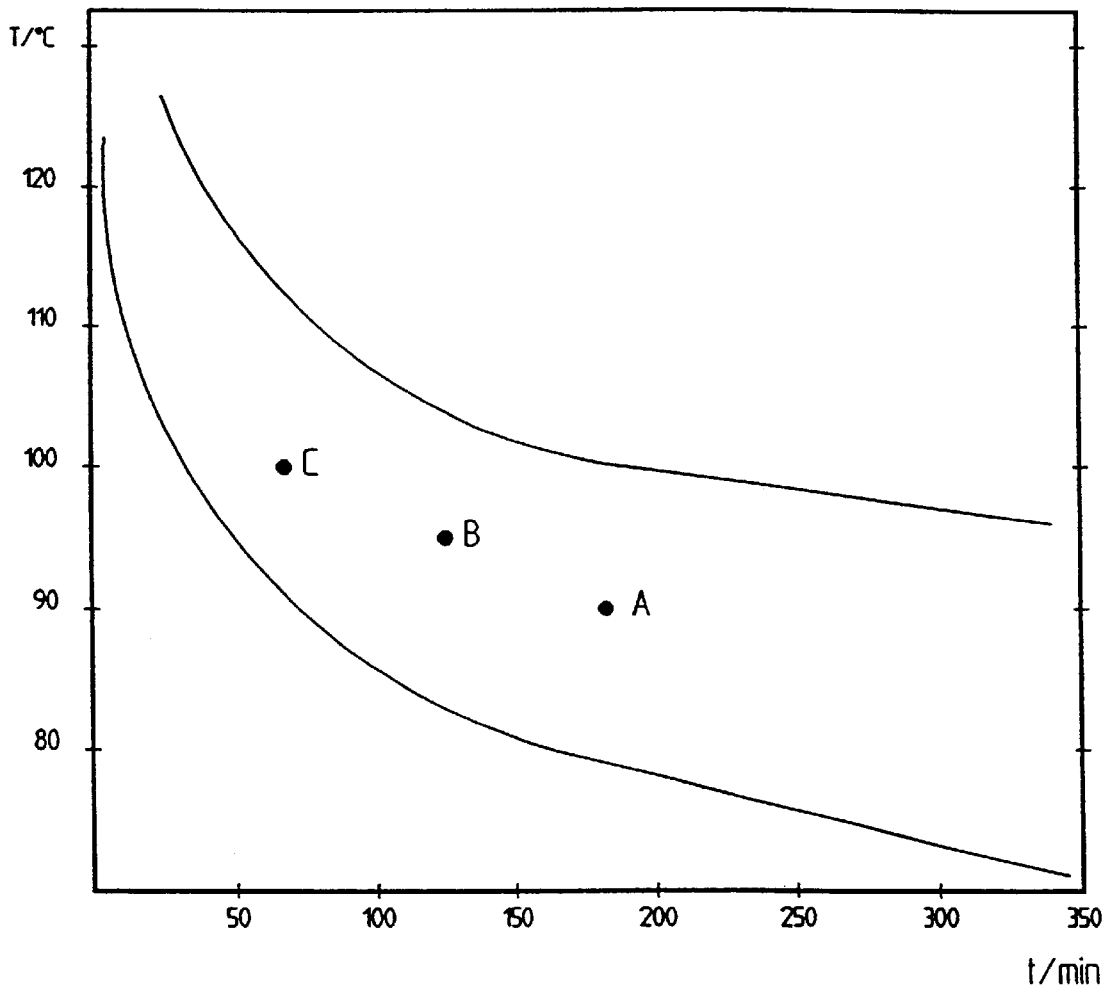
FIG. 1 illustrates graphically the optimal conditions for carrying out the invention as described above.

Prior to the tower, acid is added to the pulp in order to adjust the pH of the pulp to the range of 2–5. The acid and possibly other chemical may be added directly to the pump 12, they may be injected to a duct 16 between the pump 12 and the tower, or to a mixer 14 provided for this purpose.

In order to raise the temperature to the required level steam is added to the pulp. Steam may be added in a steam mixer (not illustrated) prior to the pump 12 or it may be mixed in the duct 16 after the pump 12 or in the particular mixed 14. Alternatively pulp may be heated indirectly in the duct 16. Also the feed end of the tower may be provided with heat transfer surfaces 22 to heat the pulp to the desired temperature.

According to the invention the pulp feed and flow to the tower is made as even as possible by using a distributor 20 or a doctor. A distributor of this kind has been disclosed for example in U.S. Pat. No. 4,964,950 and Finnish patent application 924805 discusses its use for the purpose mentioned. Correspondingly, the top of the tower has been provided with a discharger 24 or a discharge doctor. The top discharger may be provided with gas separating means as disclosed in patent applications WO 90/13344 and WO 93/01875 by A. AHLSTROM CORPORATION. The pulp is discharged via line 28 for further treatment.

When the acid tower has been provided with means controlling the pulp feed and/or discharge the retention time of the whole pulp volume flowing in the tower is even and no channeling occurs in the tower. Channelling would result in different retention times for different pulp portions and consequently part of the pulp would have to stay in the tower for a too long or a too short time. A long time in a high temperature would deteriorate the quality of the pulp. All the favourable effects on the pulp provided by the acid treatment are not reached in full if the treatment time is inadequate. Homogenous pulp can be produced by using the arrangement according to the present invention.

Figure 3:
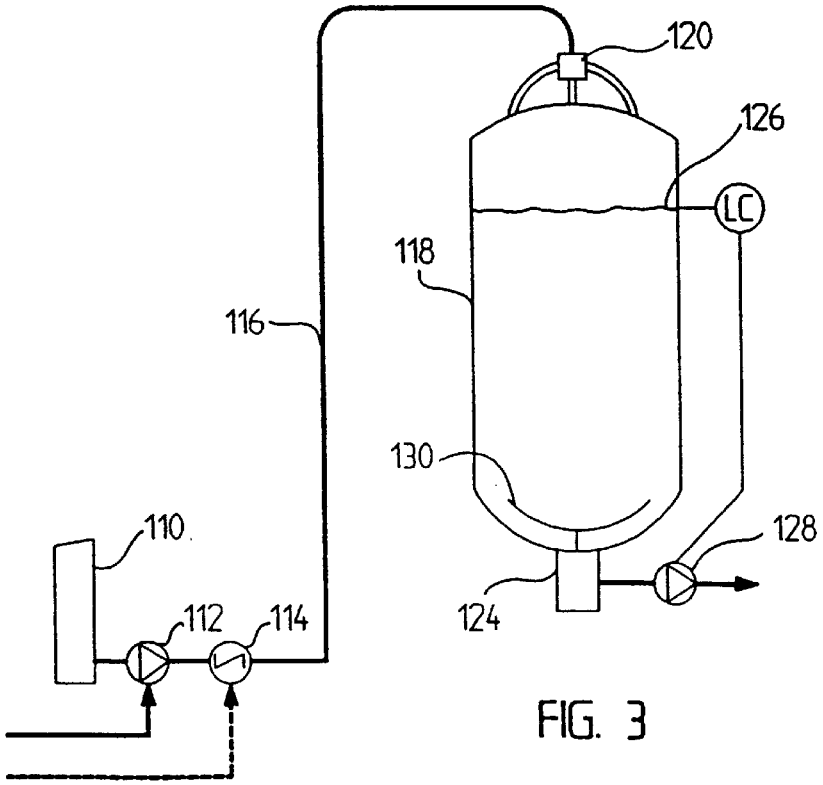
FIG. 3 illustrates a second preferred embodiment of apparatus used in carrying out the method of the invention.

FIG. 3 illustrates another apparatus for carrying out the acid treatment. Also in this embodiment pulp is pumped from a previous treatment stage 110 by a high-consistency pump 112. Acid is added in the same way as in connection with FIG. 1. The pulp is also heated as described above. An essential feature of this embodiment is that the pulp is pumped via line 116 to the top of an acid tower 118 wherefrom it flows via a distributor 120 to the tower and there downwards to the bottom of the tower. The distributor at the top evens out the temperature differences in the pulp if steam has been added to the pulp.

There is a pulp surface 126 in the tower the level of which may be controlled. In this way the pulp retention time in the tower may be regulated so that it is substantially constant for the pulp flowing in the tower. Pulp is discharged from the tower by means of a doctor 130 and a drop leg 124 and it is pumped further by a pump 128 for further treatment.

Figure 2:
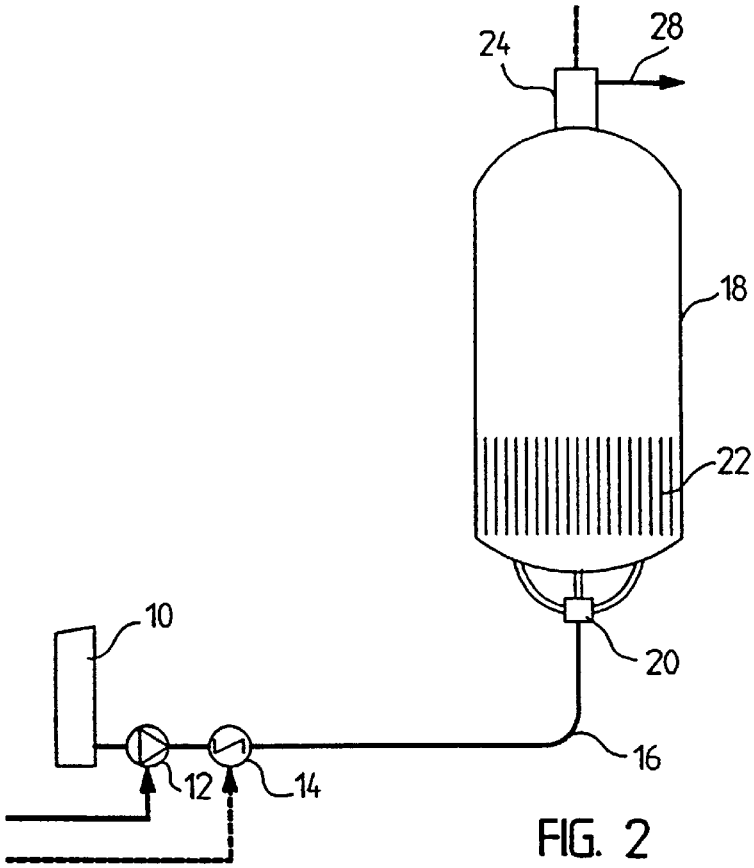
FIG. 2 illustrates a preferred embodiment of apparatus used in carrying out the method of the invention.
Figure 4:
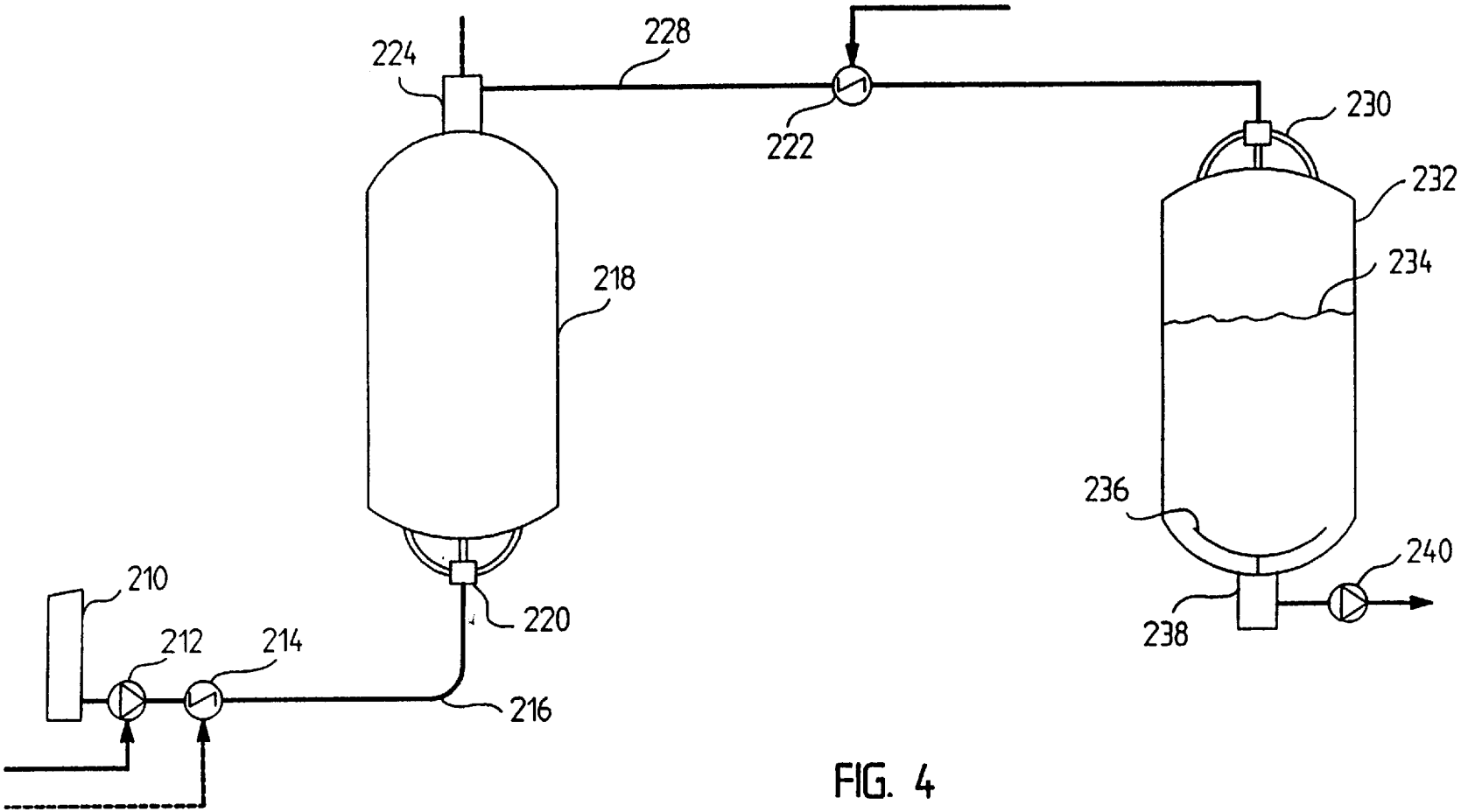
FIG. 4 illustrates a third preferred embodiment of apparatus used in carrying out the method of the invention.

FIG. 4 illustrates an embodiment combining the tower types illustrated in FIGS. 2 and 3. Thus the acid treatment is two-stepped. Pulp is fed from a stage 210 preceding the acid treatment by a high-consistency pump 212 in line 216 via a distributor 220 to a first acid tower 218. Acid may be mixed into the pulp as described in connection with FIG. 1. Also heating of the pulp may be similar to the one in FIG. 1.

The pulp is transferred by means of the pressure generated by the first acid tower 218, or in fact by the feed pump 212, to a distributor 230 at the top of the second acid tower 232. Thus, pumping is not necessary between the towers. In the tower 232 the pulp flows downwards in the same way as in the tower embodiment illustrated in FIG. 3. The retention of the pulp in the acid tower 232 is controlled by controlling the pulp level 234. Pulp is discharged from the tower by means of a doctor 236 and a drop leg 238 and is transferred by a pump 240 to a following treatment stage.

An advantage provided by a two-step acid treatment is that between the towers there still is a change for fine adjustment of the treatment conditions such as pH, temperature or other factors in order to optimize them. An alternative is to add in the duct 228 complex former which binds harmful metals and at the same time to raise the pH. For this purpose a mixer 222 may be provided in the duct. Alternatively, the pulp discharge means 224 may be designed to be capable of mixing chemicals and/or raising pressure.

As may be understood from the above, a characteristic feature of the present invention is that acid treatment may be carried out as a two-step or a multi-step process in successive towers in order to optimize acid treatment conditions. Various adjustments may be made between the steps for example to keep the pH within the optimal range.

Figure 5:
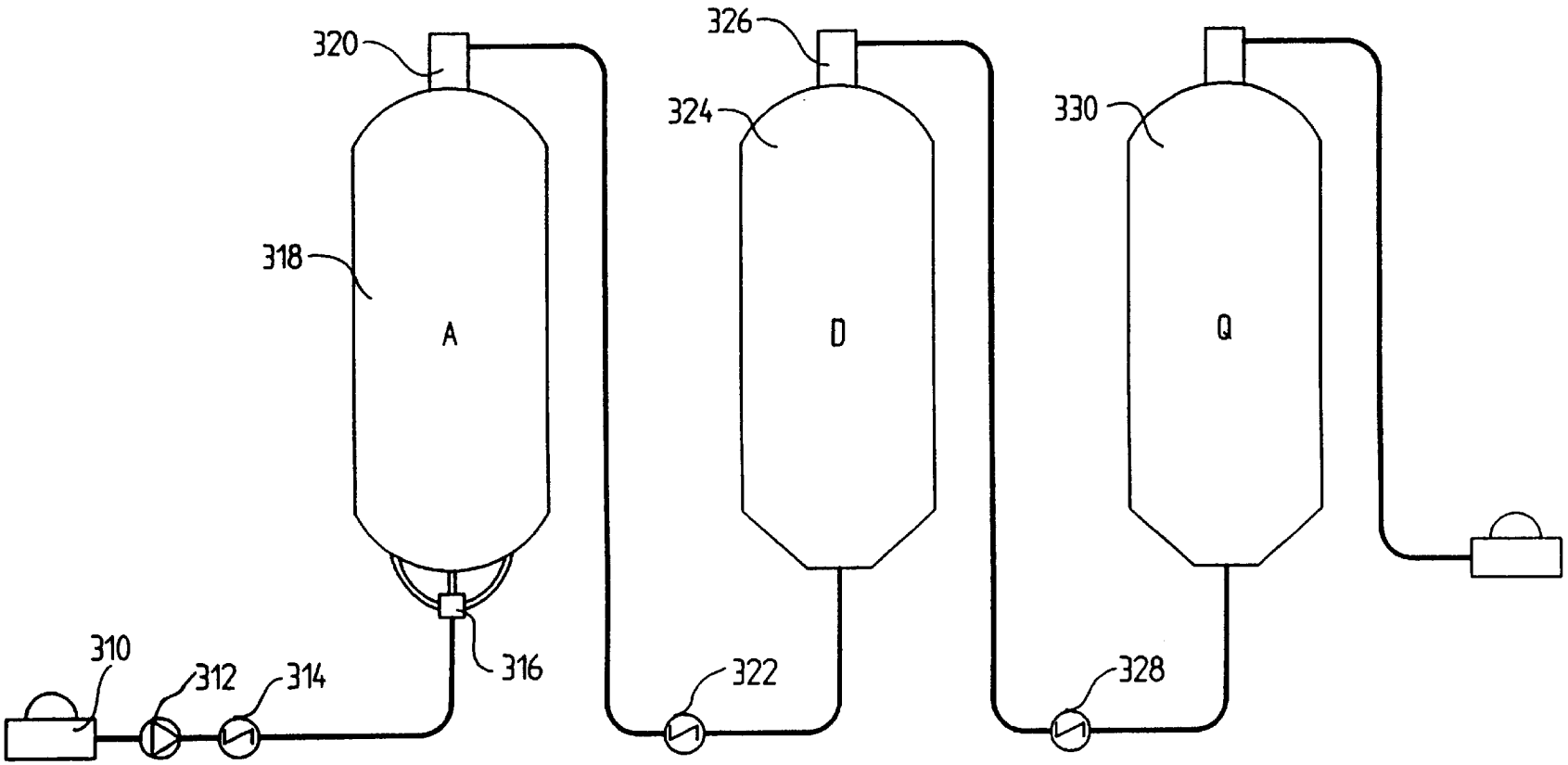
FIG. 5 illustrates a fourth preferred embodiment of apparatus used in carrying out the method of the invention.

FIG. 5 illustrates a process arrangement according to a preferred embodiment of the invention. FIG. 5 illustrates a way of carrying out the bleaching sequence ADQ although a tower arrangement of the similar type may be employed also in an AD stage in which case the A step is carried out in a two-tower embodiment as illustrated in FIG. 4. FIG. 5, however, illustrates that the pump comes from a washer 310 which may be a brown stock washer, a washer following an oxygen delignification process or a washer following some other treatment stage. It should be borne in mind that the stage according to the invention need not be preceded by a washer but the preceding means may be for example a storage tower or some other tower. However, in the embodiment illustrated, pulp is pumped by a high-consistency pump 312 to a mixer 314 in which acid in mixed into the pump in order to adjust the pH to the range required by the acid treatment described above. The acid as well as many other chemicals may well be mixed directly with a so-called MC pump. The pulp is guided from the mixer to a distributor 316 which ensures that the pulp is evenly distributed over the whole cross-sectional area of the acid tower 318 which in turn ensures that the pulp column rises upwards smoothly minimizing the risk of channeling. The temperature of the pulp is controlled either by adding steam when needed to the pulp in the mixer 314 or in the pipe line following it, or by raising the temperature of the pulp indirectly in connection with the pipe line or in the tower 318 itself. The tower 318 has been dimensioned according to the retention time required by the acid treatment. The top of the tower 318 has been provided with a top discharger 320 by means of which pulp is preferably discharged to a mixer 322 in which chlorine dioxide and other required chemicals are mixed into the pulp.

The task of the mixer may be performed also by the top discharger 320 which eliminates the need of a separate mixer. The pulp is transferred from the mixer to a D tower 324 either via one feed connection as illustrated or via several feed connections by applying the distributor 316 illustrated in connection with the tower 318. As described in connection with the tower 318, the pulp is discharged from the tower 324 by means of a top discharger 326 in which chelating against required by the subsequent step may be mixed into the pulp or gas may be separated from the pulp. If it is desirable to employ a separate mixer 328 it may be installed preceding the Q tower 330 and the discharge therefrom may be effected as already described.

Figure 6:
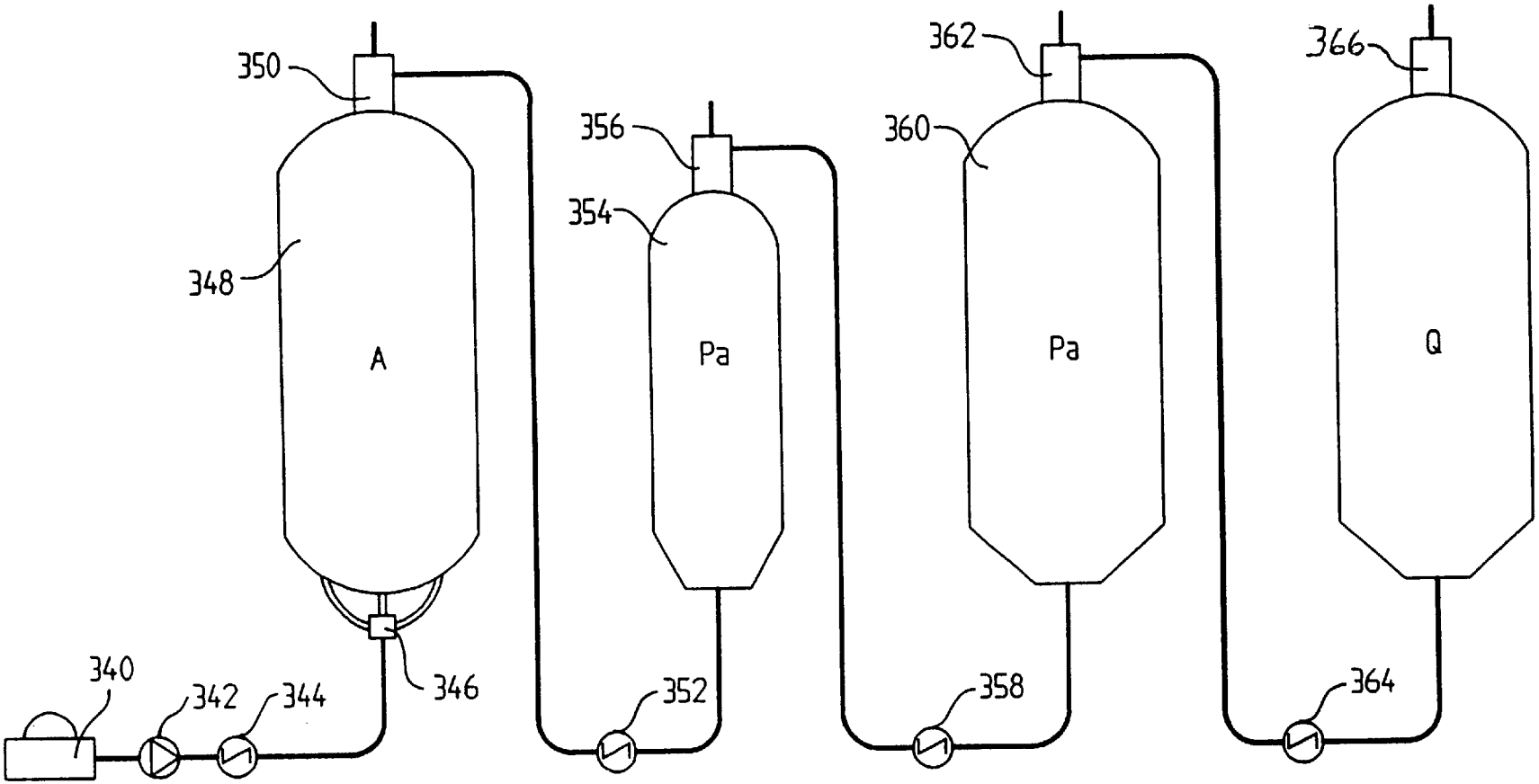
FIG. 6 illustrates a fifth preferred embodiment of apparatus used in carrying out the method of the invention.

FIG. 6 illustrates a process arrangement according to another preferred embodiment of the invention. The figure illustrates an apparatus diagram for example for an $AP_aQ$ stage in which the acid peroxide step, i.e. the $P_a$ step, is carried out in two towers. As described above the pulp is fed by means of a high-consistency pump 342 from a preceding apparatus 340 to a mixer 344 in which acid, and if desired also steam, is mixed into the pulp. The pulp is guided preferably via a distributing feed apparatus 346 to an A tower and from this tower the pulp is removed via a top discharger 350 to a mixer 352 in which chemicals required by the acid peroxide stage are mixed into the pulp and if it is desirable to pressurize the stage, also oxygen is mixed into the pulp to create the pressure required in the reactor 354. Residual gas is separated from the pulp in the discharger 356 at the top of the reactor 354 and after that the pulp is transferred to a mixer 358 in which more chemicals are mixed into the pulp in order to effect the second acid peroxide step in a tower 360. The feed into the towers 354 and 360 and also to a subsequent tower 366 may be carried out preferably and if desired via a distributing feed apparatus which prevents the pulp flow from channeling in the tower. From the second peroxide tower 360 the pulp is discharged via a top discharger 362 to a following mixer 364 in which chelating agents are mixed into the pulp and if necessary also other chemicals required by the Q stage.

It should be noted that the acid peroxide step could be run also in one tower for example in the way described in connection with FIG. 5 in which case the D tower could be used as a $P_a$ tower. The peroxide dose in the acid stage is of the order 1–30 kg/ADMT, preferably 5–20 kg/ADMT.

Figure 7:
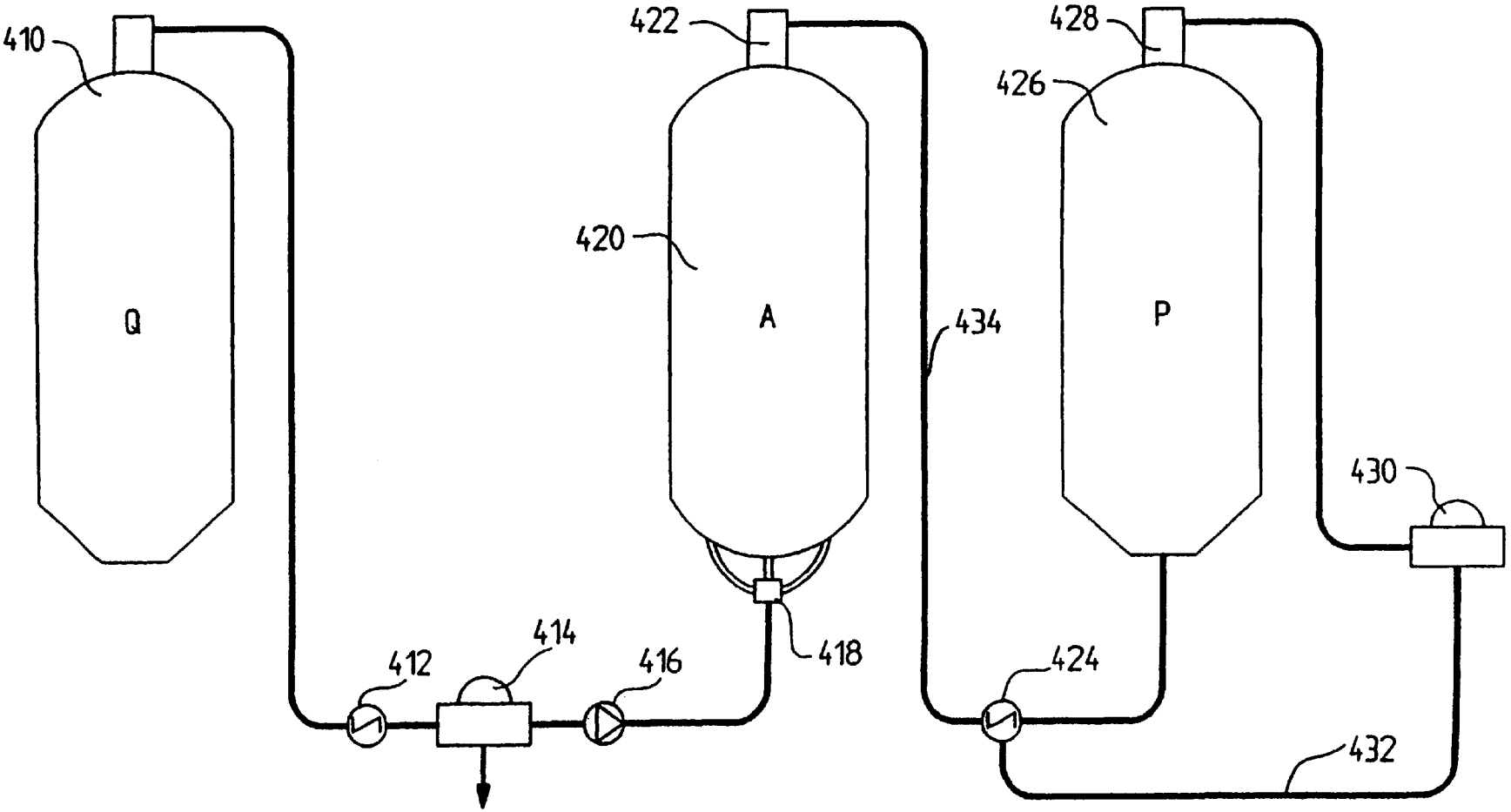
FIG. 7 illustrates a sixth preferred embodiment of apparatus used in carrying out the method of the invention.

FIG. 7 illustrates a preferred embodiment of a process arrangement according to the invention. FIG. 7 illustrates a preferred way of effecting an AP bleaching stage whereby the residual peroxide is utilized. The pulp comes from a tower 410 in which it has been treated with a complex former in order to remove harmful metals and to provide a favourable metals profile in the pulp. Acid is added to the pulp in a mixer 412, a washer 414 or a pump 416 in order to adjust the pH for the acid treatment according to the invention. In the press 414 which is preferably a washing press the consistency of the pulp is raised to the range of 20–40%. The pulp is directed by a pump 416 to a distributor 418 which ensures that the pulp is evenly distributed over the whole cross-sectional area 420 of the acid tower whereby the pulp column rises evenly upwards minimizing the risk of channeling. The temperature of the pulp is adjusted to be appropriate either by adding steam to the pulp in the pipe line or by raising the temperature indirectly in connection with the pipe line to in the tower 420 itself. The tower has been dimensioned for the retention time required by the acid treatment. The top of the tower 420 has been provided with a top separator 422 with which the pulp is preferably discharged to a mixer 424 by means of which peroxide and if necessary other chemicals such as alkali is/are mixed into the pulp to raise the pH of the pulp for the peroxide step. The peroxide and the other chemicals possibly needed may be added also in the top discharger 422 whereby a separate mixer is not needed for this purpose.

Pulp is guided from the mixer 424 to a P tower 426 either in the manner described via one feed connection or via several feed connections by applying the distributor 418 described in connection with the tower 420. The pulp is discharged from the tower 426 via a top discharger 428 to a filter 430 in a way corresponding to the one described in connection with the tower 420. The peroxide-containing filtrate obtained from this filter is used in the dilution of the pulp to a consistency of 10–20% for the P tower 426 by adding the filtrate to the pulp in a mixer 424 of the feed line 434. In this way the residual peroxide obtained from the P tower may be utilized although there is no washing press between the A tower and the P tower into which the filtrate could be directed if the system would include an intermediate wash between the towers.

It must be borne in mind that only a few preferred embodiment of the invention have been presented above and that real scope of protection of the invention is determined by the appended patent claims, only.

What is claimed is:

1. A method of sequentially treating cellulose pulp comprising:

(a) digesting commminuted cellulosic fibrous material to produce cellulose pulp, and if necessary oxygen delignifying the pulp, to produce a cellulose pulp with a kappa number of less than 24; then (b) treating the digested pulp in at least one acid tower at a pH of between 2–5 at a temperature between 75–130° C., and, in order to prevent the strength properties of the pulp from being deteriorated, at a retention time t in minutes between 30–300 minutes, wherein the treatment temperature T in degrees centigrade is $T_{min}<T<T_{max}$ in which $$T_{\min} = \frac{10517}{24 + \ln(2t)} - 273$$

and $$T_{max}=T_{min}+23EC$$

in order to decrease the kappa number of the pulp 2–9 units;

(c) treating the acid treated pulp in at least one treatment tower different from the at least one acid tower with chlorine dioxide; and practicing steps (b) and (c) without an intermediate wash therebetween.

2. A method as recited in claim 1 wherein (a) is practiced, to produce a cellulose pulp with a kappa number of less than 14.

3. A method as recited in claim 1 wherein (b) is practiced so as to control the feed of pulp into the acid tower, and a discharge therefrom, so that homogeneous flow properties are maintained in the acid tower, so as to provide a substantially constant retention time of pulp in the tower.

4. A method as recited in claim 3 wherein (b) is practiced so that the retention time in (b) is between 45–150 minutes.

5. A method as recited in claim 1 wherein (b) is practiced in two consecutive towers operatively connected to each other for a continuous flow of pulp therebetween.

6. A method as recited in claim 1 wherein step (b) is practiced so that the pulp has a consistency of 6–25%.

7. A method as recited in claim 1 wherein step (b) is practiced so that the pulp has a consistency of 8–18%.

* * * * *